US005393635A

United States Patent [19]

Russell et al.

[11] Patent Number: 5,393,635

[45] Date of Patent: Feb. 28, 1995

[54] CHELATING NEGATIVE CHARGE DIRECTOR FOR LIQUID ELECTROGRAPHIC TONER

[75] Inventors: Dale D. Russell; James G. Bearss, both of Boise, Id.

[73] Assignee: Hewlett-Packard Company, Palo Alto, Calif.

[21] Appl. No.: 99,021

[22] Filed: Jul. 28, 1993

[51] Int. Cl.[6] ..... G03G 9/135

[52] U.S. Cl. ..... 430/115; 430/137

[58] Field of Search ..... 430/106, 115, 137

[56] References Cited

U.S. PATENT DOCUMENTS

| | | | |
|---|---|---|---|
| 2,786,440 | 3/1957 | Giaimo, Jr. | 118/61 |
| 2,907,674 | 10/1959 | Metcalfe et al. | 117/37 |
| 4,897,332 | 1/1990 | Gibson et al. | 430/115 |
| 4,925,766 | 5/1993 | Elmasry et al. | 430/115 |
| 5,045,425 | 9/1991 | Swidler | 430/115 |
| 5,130,221 | 7/1992 | El-Sayed et al. | 430/115 |
| 5,144,036 | 9/1992 | Alexandrovich et al. | 546/13 |

OTHER PUBLICATIONS

Mechanism Of Electric Charging Of Toner Particles in Nonaqueous Liquid With Carboxylic Acid Charge Additives.

*Primary Examiner*—John Goodrow

[57] ABSTRACT

The invention is a negative charge director for liquid electrographic toners. The charge director comprises a very weakly associating, charged functional group covalently bonded in the resin coating of the toner particle, and a very strongly chelating, preferably neutrally charged, molecule dispersed in the liquid phase to achieve charge separation. The weak association site on the resin is prepared, via well-known ion-exchange chemistry, in the metal form desired. Preferred metals are those with no regulatory, health or environmental issues, such as $K+$, $Na+$, $Ca^{2+}$, $Al^{3+}$, $Zn^{2+}$, $Zr^{4+}$, $Mg^{2+}$, ammonium ($NH_4+$), and organic cations.

The cation-associated resin is brought into dispersion with the solution phase chelating molecule. When this is done, the equilibria that compete for the cation are such that it is released from the resin and bound in the chelate. The toner particle is left with a net negative charge which is permanent, but which is balanced by an equal, opposite charge on the chelated cationic species in the continuous phase. Preferably, there are no other sources of charge in the dispersion, and there is no excess of charge carriers in the continuous phase which would interfere with development.

16 Claims, 1 Drawing Sheet

CHELATING NEGATIVE CHARGE DIRECTOR FOR LIQUID ELECTROGRAPHIC TONER

FIELD OF THE INVENTION

This invention relates generally to liquid toner dispersions of the type used in electrophotography. More specifically, the invention relates to toner particles containing charge directors left with a net negative charge after contact with a strongly chelating molecule in the liquid toner dispersions.

BACKGROUND OF THE INVENTION

In electrophotography, a latent image is created on the surface of a photoconducting material by selectively exposing areas of the charged surface to light. A difference in electrostatic charge density is created between the areas on the surface exposed and unexposed to light. The visible image is developed by electrostatic toners containing pigment components and thermoplastic components. The toners are selectively attracted to the photoconductor surface either exposed or unexposed to light, depending on the relative electrostatic charges of the photoconductor surface, development electrode and the toner. The photoconductor may be either positively or negatively charged, and the toner system similarly may contain negatively or positively charged particles. For laser printers, the preferred embodiment is that the photoconductor and toner have the same polarity, but different levels of charge.

A sheet of paper or intermediate transfer medium is then given an electrostatic charge opposite that of the toner and passed close to the photoconductor surface, pulling the toner from the photoconductor surface onto the paper or intermediate medium, still in the pattern of the image developed from the photoconductor surface. A set of fuser rollers fixes the toner to the paper, subsequent to direct transfer, or indirect transfer when using an intermediate transfer medium, producing the printed image.

The toner may be in the form of a dust, i.e., powder, or a pigment in a resinous carrier, i.e., toner, as described, for examples in Giaimo, U.S. Pat. No. 2,786,440, issued Mar. 26, 1957. The toner particles may be used or fixed to the surface by known means such as heat or solvent vapor, or they may be transferred to another surface to which they may similarly be fixed, to produce a permanent reproduction of the original radiation pattern.

Dry development systems suffer from the disadvantage that distribution of the powder on the surface of the photoconductor, and the charge to mass ratio of the particles, are difficult to control. They can have the further disadvantages that excessive amounts of dust may be generated and that high resolution is difficult to attain due to the generally relatively large size of the powder particles, generally greater than 5 μm. When particle size is reduced below 5 μm, particle location becomes more difficult to control. Many of these disadvantages are avoided by the use of a liquid developer of the type described, for example, in Metcalfe et al., U.S. Pat. No. 2,907,674, issued Oct. 6, 1959. Such developers usually comprise a non-polar and non-conducting liquid which serves as a carrier and which contains a dispersion of charged particles comprising a pigment such as carbon black, generally associated with a resinous binder such as, for example, an alkyd resin. A charge control agent is often included in order to stabilize the magnitude and polarity of the charge on the dispersed particles. In some cases, the binder itself serves as a charge control agent, also known as a charge director.

Liquid developers are also frequently used in toner transfer systems. When so used, they must give consistently high uniform density not only on the element on which the image is initially formed but also on the transfer or receiver sheet.

It is necessary in electrophotography to have electrical charge on the toner particles in order to impel them to move toward the photoconductor surface via electrical field. The principle is easily achieved in dry powder systems, but more difficult in liquid toners. The reason for the difficulty is that the solution phase for liquid toners makes it impossible to charge the particles triboelectrically. Instead, they must have formal and relatively permanent charge arising either from their chemistry, or from non-specifically adsorbed species which are themselves permanently charged. In addition, the charge on the particles must not cause flocculation or destabilization of the toner, and must remain on the particles, keeping the bulk conductivity of the solution phase at a low and controlled level.

Several patents teach methods of charge direction for liquid electrographic toners. One method, disclosed in U.S. Pat. No. 4,925,766 (Elmasry et al.), shows the use of metal soaps (such as $Z^{4+}$ soap) to provide metal ions (such as $Zr^{4+}$ ion) which are then more or less bound coordinatively on the resin coating of the pigment. Several functional groups may be incorporated into the resin to provide the binding sites for the $Zr^{4+}$ or other metal. These binding functionalities are shown in cols. 9 and 10 of this patent. They typically possess oxygen or nitrogen to donate electron pairs into the coordination sphere of the metal ion. The oxygen donor sites are typically protonated, such as in carboxylic acids and phenols. Alternatively, they may be non-protonated, such as in nitrogen donor atoms or beta-diketones. These electron donor groups are ideally bi- or polyodentate so as to chelate, i.e., bind, to the metal atom at two or more points. The advantage of chelating and other polydentate ligands, as opposed to monodentate ligands, is that they increase the probability that the metal ion will actually be located on the toner particle, and not associated with the liquid phase. When the charged metal species is unbound, and in the liquid phase, it contributes to bulk phase conductivity of the medium, and not to migration of the toner particle in the field. In fact, it even suppresses toner migration due to its greater electrophoretic mobility.

Another disadvantage of these metal soap charge direction systems is that many of them, and the most widely used ones, employ protonated binding sites. This means that when the metal is bound into the resin the proton with its associated charge must go somewhere. If it goes into the continuous phase it contributes to background conductivity and serves to suppress particle migration in the electrical field. There is residual water in virtually all liquid toners, and the proton may go into the residual water. If this happens there may be micro-micellar formation which can promote flocculation of the toner. This is one possible explanation for the observed flocculation phenomena in this type of toner.

Another patent U.S. Pat. No. 5,045,425 (Swidler) teaches incorporation of salicylates in the resin, and addition of $Al^{3+}$ complexes of salicylates to the dispersion. In this case, the formation constant of the $Al^{3+}$ complex with the surface salicylate groups is high, and if the total concentration of the aluminum is optimized, most of it is bound to the surface of the toner particle. The remainder of the aluminum is bound up in homogeneously dispersed complexes, in the liquid phase. The role of these complexes in overall measured conductivity of the toner is unclear, but certainly does nothing to promote migration of the toner particles toward the discharged areas of the photoconductor.

The article "*Mechanism of Electric Charging of Toner Particles in Nonaqueous Liquid with Carboxylic Acid Charge Additives*" by K. Pearlstine, L. Page and L. El-Sayed, *Journal of Imaging Science,* Vol. 35, No. 1, Jan./Feb. 1991, pp. 55–58, discloses toner particles containing carboxylic acids substituted with electron-withdrawing groups as charge directors. The carboxylic acid groups disclosed in this article are bound, or associated with, the toner particles by Van der Waals forces.

In these prior art cases then, a metal ion more or less bound to the particle surface is used as the charge director. The resulting charge on the particle is thus more or less semi-permanent and electrically positive. There is, however, a high probability that at least some of the total charge in the system is spread uniformly throughout the continuous phase and not localized on the particles.

Other prior art toner systems exist which rely on the non-specific adsorption of a large, negatively charged organic species such as lecithin to provide negative charge direction. See, for example, U.S. Pat. No. 4,897,332 (Gibson et al.). There are two main disadvantages of these systems. First, the charge is not bound to the particle as a permanent or semi-permanent part of the structure, but is rather loosely associated with it, via Van der Waals forces. Secondly, in order to achieve significant charge on the particles, it is necessary to add excess charge director material to the liquid toner. This invariably means there will be an excess of unassociated charge director in the continuous phase which, as before, actually suppresses the desired migration of the toner particles in the field.

SUMMARY OF THE INVENTION

The invention is a negative charge director for liquid electrographic toners. The charge director comprises a very weakly associating, charged functional group covalently bonded in the resin coating or to the pigment component of the toner particle, and a very strongly chelating, preferably neutrally charged, molecule in the solution or liquid phase to achieve charge separation. The weak association site on the resin is prepared, via well known ion-exchange chemistry, in the metal form desired. Preferred metals are those with no regulatory, health or environmental issues, such as $K^+$, $Na^+$, $Ca^{2+}$, $Al^{3+}$, $Zn^{2+}$, $Zr^{4+}$, $Mg^{2+}$, ammonium ($NH_4^+$) and organic cations such as $RNH_3^+$, $R_2NH_2^+$, $R_3NH^+$, and $R_4N^+$, where R is any alkyl, allyl or aryl group.

The cation-associated resin is brought into dispersion with the solution phase chelating molecule. When this is done, the equilibria that compete for the cation are such that the metal is released from the resin and bound in the chelate. The toner particle is left with a net negative charge which is permanent, but is balanced by an equal, opposite charge on the chelated metal species in the continuous phase. Preferably, there are no other sources of charge in the dispersion, and there is no excess of charge carriers in the continuous phase which would interfere with development.

DETAILED DESCRIPTION OF THE INVENTION

Figure 1:
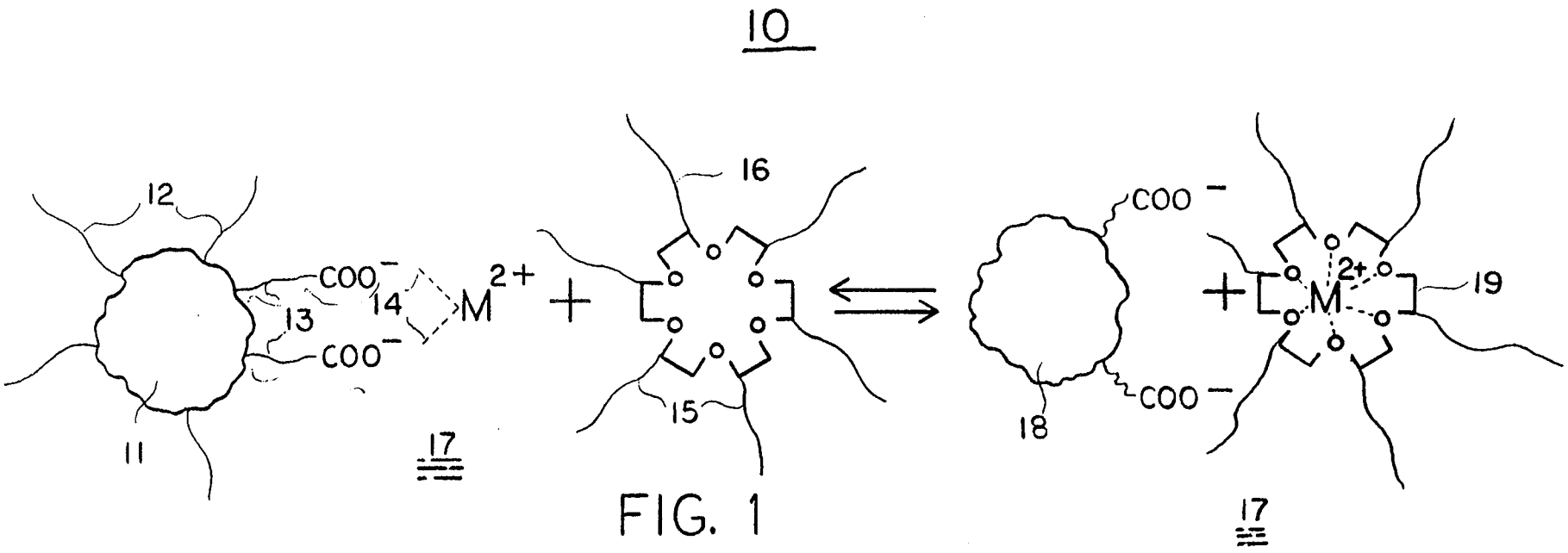
FIG. 1 is a schematic representation of one embodiment of the method of this invention wherein the toner particle with the weakly associated metal ion is in equilibrium with an uncharged, strong chelating agent.

Referring to FIG. 1, there is schematically depicted the equilibrium 10 which exists in the liquid toner of this invention. On the left-hand side of the equilibrium equation is neutrally charged toner particle 11 with optional steric stabilizer polymer portions 12, and negatively charged carboxylic acid groups 13 covalently bonded to steric stabilizers 12. The carboxylic acid groups 13 are weakly associated, as indicated by the dashed lines 14, to metal cation $M^{2+}$. The metal cation may be selected from the list of $K^+$, $Na^+$, $Ca^{2+}$, $Al^{3+}$, $Zn^{2+}$, $Zr^{4+}$, $Mg^{2+}$, ammonium ($NH_4^+$), and organic cations such as $RNH_3^+$, $R_2NH_2^+$, $R_3NH^+$and $R_4N^+$, where R is any alkyl, allyl, or aryl group, for example. The neutral charge for the toner particle is a result of the close association of the two negatively charged acid groups and the positively charged metal ion.

Also, on the left hand side of the equilibrium equation is uncharged chelating agent 15 with optional steric stabilizer polymer portions 16. The chelating agent 15 is a strongly chelating agent like 18-crown-6 ether, for example. Toner particle 11 and chelating agent 15 are well-dispersed in non-polar, non-conducting liquid 17.

On the right hand side of the equilibrium sign is negatively charged toner particle 18 and chelated metal counter ion 19. The negative charge for toner 18 is a result of the freely-extending negatively charged carboxylic acid groups without close corresponding positively charged metal ions. The positive charge for counter ion 19 is a result of the strongly chelated positively charged metal cation $M^{2+}$, surrounded by the uncharged chelating agent 15, but without close corresponding negatively charged anions.

For this application, "association" means correlation due to permanent opposite polarities or charges, for example, as in anions and cations in solution. "Complexing" means the same as "coordinating" which means combination resulting from plural shared electrons originating from the same atom, for example, as in an ion-exchange resin selective for metals. "Chelation" means complexation or coordination from multiple donor atoms in the same molecule such as nitrogen, sulfur and oxygen. "Covalent" means combination resulting from plural shared electrons originating from different atoms, for example, as in simple hydrocarbons. "Ionic" means combination resulting from the transfer of one or more electrons from one atom to another, for example, as in metal salts. "Van der Waals force" means combination resulting from a fluctuating dipole moment in one atom which induces a dipole moment in another atom, causing the two dipoles to interact.

As a carrier liquid for the liquid toner dispersions of the invention, those having an electric resistance of at least $10^2\Omega$cm and a dielectric constant of not more than 3.5 are useful. Exemplary carrier liquids include straight-chain or branched-chain aliphatic hydrocarbons and the halogen substitution products thereof. Examples of these materials include octane, isooctane, decane, isodecane, decalin, nonane, dodecane, isododecane, etc. Such materials are sold commercially by Exxon Co. under the trademarks: Isopar®-G, Isopar®-H, Isopar-K, Isopar®-L, Isopar®-V. These particular hydrocarbon liquids are narrow cuts of isoparaffinic hydrocarbon fractions with extremely high levels of purity. High purity paraffinic liquids such as the Norpar TM series of products sold by Exxon may also be used. These materials may be used singly or in combination. It is presently preferred to use Norpad®-12.

The pigment components that are to be used are well known. For instance, carbon blacks such as channel black, furnace black or lamp black may be employed in the preparation of black developers. One particularly preferred carbon black is "Mogul L" from Cabot. Organic pigments, such as Phthalocyanine Blue (C.I.No. 74 160), Phthalocyanine Green (C.I.No. 74 260 or 42 040), Sky Blue (C.I.No. 42 780), Rhodamine (C.I.No. 45 170), Malachite Green (C.I.No. 42 000), Methyl Violet (C.I. 42 535), Peacock Blue (C.I.No. 42 090), Naphthol Green B (C.I.No. 10 020), Naphthol Green Y (C.I.No. 10 006), Naphthol Yellow S (C.I.No 10 316), Permanent Red 4R (C.I.No. 12 370), Brilliant Fast Pink (C.I.No. 15 865 or 16 105), Hansa Yellow (C.I.No. 11 725), Benzidine Yellow (C.I.No. 21 100), Lithol Red (C.I.No. 15 630), Lake Red D (C.I.No. 15 500), Brilliant Carmine 6B (C.I.No. 15 850), Permanent Red F5R (C.I.No. 12 335) and Pigment Pink 3B (C.I.No. 16 015), are also suitable. Inorganic pigments, for example Berlin Blue (C.I.No. Pigment Blue 27), are also useful. Additionally, magnetic metal oxides such as iron oxide and iron oxide/magnetites may be mentioned. Any colorant in the *Colour Index*, Vols. 1 and 2, may be used as the pigment component.

As is known in the art, binders are used in liquid toner dispersions to fix the pigment particles to the desired support medium such as paper, plastic film, etc., and to aid in the pigment charge. These binders may comprise thermoplastic or thermostetting resins or polymers such as ethylene vinyl acetate (EVA) copolymers (Elvax® resins, DuPont), varied copolymers of ethylene and an $\alpha,\beta$-ethylenically unsaturated acid including (meth) acrylic acid and lower alkyl ($C_1$–$C_5$) esters thereof, and polymers of other substituted acrylates. Copolymers of ethylene and polystyrene, and isostatic polypropylene (crystalline) may also be mentioned. Both natural and synthetic wax materials may also be used.

The binder resins or pigment components, or both, of this invention have incorporated in them "weakly" associating groups such as carboxylates, quinolinates or sulfonates, for example.

When making the liquid toner dispersion of this invention, the "weakly" associating group is ion exchanged until it is in the desired cation form, preferably, for example, $Na^+$, $K^+$, $Ca^{2+}$ or $Mg^{2+}$. Then, a stabilized, preferably uncharged, "strongly" chelating group is added to the ion-exchanged dispersion. Preferred "strongly" coordinating groups include 18-crown-6, 15-crown-5 ether, phthalocyanines and substituted phthalocyanines, and porphines and substituted porphines, for example, and other meso or macro-cyclic or other open or flexible chain molecules having at least 3 donor atoms (polydentate).

For this application, the terms "weakly associating" and "strongly chelating" are relative terms, defined by the components' relative equilibrium constants $K_f$. For this invention, if the ratio, $K_f$(chelate)/$K_f$(associate), is greater than $10^3$, the chelate is considered "strongly chelating", and the resin or pigment association is considered "weakly associating".

In this dispersion of the weakly associating ion-exchanged group and the strongly chelating group, the equilibrium favors disruption of the weak association bond with the cation, and formation of the chelate, producing charge separation.

EXAMPLE I

Ion-Exchanging and Dispersing the Resinous Carrier

About 10 g. of Bio Rad Company's Analytical Grade macroporous cation exchange resin//AG MP-50, 50–100 mesh, hydrogen form, was added to a saturated solution of $CaCl_2$ at room temperature and stirred to form a slurry. This was more than enough $Ca^{2+}$ to completely exchange all of the $H^+$ in the resin with $Ca^{2+}$.

The slurry was tested for pH and rinsed repeatedly until the pH was at least 7.0. Then, the water was drained from the resin, which was dried in a vacuum oven at 90° C. overnight. The resulting dried resin was ground to a fine powder with a mortar and pestle, and 4.7653 g. of the powder was homogenized with a high-speed mixer into 200 ml of Norpar 12.

The same procedure as above was done with the following cation exchange resins:

1. Bio-Rex 70 ($Ca^{2+}$)
2. Bio-Rex 70 ($K^+$)
3. Chelex 100 ($Zr^{4+}$)
4. Chelex 100 ($Al^{3+}$)

Providing the Strongly Chelating Molecule

Ethylenediamine tetraacetic acid (EDTA) was acidulated with 1N nitric acid. The free acid precipitated and was decanted. The precipitate was rinsed with reagent grade acetone and dried in a vacuum oven at 100° C. overnight. The resulting dried chelate was ground to a fine powder. Crystalline 18-crown-6 ether was used as received from the manufacturer (Aldrich Chemical Co.).

Testing for Conductivity

The protocol was to measure conductivity, in picomho's, of:

a. baseline
b. Norpar 12
c. with added resinous carrier,
d. with added chelating agent, and
e. with both added resinous carrier and with added chelating agent

| Results | | |
|---|---|---|
| 1. | | |
| a. base | 0.03 | |
| b. Norpar-12 | 0.07 | |
| c. with Chelex-100 ($Zn^{2+}$) | 0.06 | |
| d. with EDTA | — | (not measured) |
| e. with both | 0.09 | |
| 2. | | |
| a. base | 0.03 | |
| b. Norpar-12 | 0.08 | |
| c. with Chelex-100 ($Al^{3+}$) | 0.08 | |
| d. with EDTA | 0.08 | |
| e. with both | 0.12 | |
| 3. | | |
| a. base | 0.03 | |
| b. Norpar-12 | 0.06 | |
| c. with Bio-Rex ($K^+$) | — | (not measured) |
| d. with 18-crown-6 | 0.06 | |

-continued

| Results | |
|---|---|
| e. with both | 0.28 |
| 4. | |
| a. base | 0.03 |
| b. Norpar-12 | — (not measured) |
| c. with Chelex-100 ($K^+$) | 0.05 |
| d. with 18-crown-6 | 0.07 |
| e. with both | 0.20 |

These results establish that the conductivity of Norpar®-12 toner dispersions containing both the added resinous carrier with the weakly coordinating group and the added strongly chelating molecule is appreciably higher than similar dispersions of Norpar®-12 without the additives or with only one of the two additives alone.

One advantage of this invention is that unreacted chelating agent has no charge, and therefore, does not affect the bulk conductivity of the liquid toner. Also, when 4 to 6 strongly chelating groups are provided on the same molecule, this greatly encourages the equilibrium to be towards the right side of the reaction depicted in FIG. 1. Also, less unreacted charged items may help minimize micelie formation in, and excessive flocculation of, the liquid toner.

While there is shown and described the present preferred embodiment of the invention, it is to be distinctly understood that this invention is not limited thereto but may be variously embodied to practice within the scope of the following claims.

What is claimed is:

1. A liquid toner dispersion for electrography comprising:

a non-polar, non-conducting liquid;

a toner particle comprising a pigment component and a resinous carrier, dispersed in said non-polar, non-conducting liquid;

a very weakly associating, negatively charged functional group covalently bonded to said resinous carrier or to said pigment component, said charged functional group resulting in a net negative charge on said toner particle; and a strongly chelated metal, ammonium, or organic cation also dispersed in said non-polar, non-conducting liquid, said metal, ammonium or organic cation being chelated by a strong chelating agent so that the net charge of said dispersion is neutral.

2. The liquid toner dispersion of claim 1 wherein the negatively charged functional group is a carboxylate.

3. The liquid toner dispersion of claim 1 wherein the negatively charged functional group is a quinolinate.

4. The liquid toner dispersion of claim 1 wherein the negatively charged functional group is a sulfonate.

5. The liquid toner dispersion of claim 1 wherein the strongly chelating molecule comprises 18-crown-6 ether.

6. The liquid toner dispersion of claim 1 wherein the strongly chelating molecule comprises 15-crown-5 ether, or any meso or macro cyclic or N- or S- substituted meso or macro cyclic crown ether or open chain polydentate ligand.

7. The liquid toner dispersion of claim 1 wherein the strongly chelating molecule comprises a phthalocyanine or substituted phthalocyanine; or a porphine or substituted porphine.

8. The method of making a liquid toner dispersion for electrography comprising:

incorporating a very weakly associating negatively charged functional group by covalent bonding in the resin coating or pigment component of a toner particle comprising a pigment component and a resinous carrier to provide a weak association site on the toner particle;

ion-exchanging the weak association site to provide there a metal, ammonium, or organic cation; and, contacting the cation-containing toner particle with a strongly chelating molecule dispersed in a non-polar, non-conducting liquid so that the cation is released from the toner particle which is left with a, net negative charge, and the cation is chelated by the said strongly chelating molecule.

9. The method of claim 8 wherein the strongly chelating molecule is neutrally charged.

10. The method of claim 8 wherein the negatively charged functional group is a carboxylate.

11. The method of claim 8 wherein the negatively charged functional group is a quinolinate.

12. The method of claim 8 wherein the negatively charged functional group is a sulfonate.

13. The method of claim 8 wherein the strongly chelating molecule comprises 18-crown-6 ether.

14. The method of claim 8 wherein the strongly chelating molecule comprises 15-crown-5 ether or any meso or macro cyclic or N- or S-substituted meso or macro cyclic crown ether or open chain polydentate ligand.

15. The method of claim 8 wherein the strongly chelating molecule comprises a phthalocyanine or a substituted phthalocyanine.

16. The method of claim 8 wherein the strongly chelating molecule comprises a porphine or a substituted porphine.

* * * * *